US007096797B2

(12) United States Patent
Sharpe et al.

(10) Patent No.: US 7,096,797 B2
(45) Date of Patent: Aug. 29, 2006

(54) PORTABLE COLLAPSIBLE TABLE AND GAME BOARD

(76) Inventors: Melanie A. Sharpe, 657 Escanaba Ave., Calumet City, IL (US) 60409; Anton J. Sharpe, 12556 S. Union, Chicago, IL (US) 60628

( * ) Notice: Subject to any disclaimer, the term of this patent is extended or adjusted under 35 U.S.C. 154(b) by 118 days.

(21) Appl. No.: 10/845,612

(22) Filed: May 14, 2004

(65) Prior Publication Data

US 2005/0252422 A1 Nov. 17, 2005

(51) Int. Cl.
*A47B 1/06* (2006.01)

(52) U.S. Cl. ..... 108/43; 108/67

(58) Field of Classification Search ..... 108/43, 108/67, 68, 163, 166, 170, 169, 38; 248/436, 248/188.6

See application file for complete search history.

(56) References Cited

U.S. PATENT DOCUMENTS 2,549,242 A 4/1951 Ross
2,693,258 A 11/1954 Fleisch
2,808,191 A 10/1957 Cramer
3,704,674 A * 12/1972 Johnson ..... 108/118
3,884,159 A 5/1975 Paria
3,993,003 A 11/1976 James
4,026,219 A * 5/1977 Shupe et al. ..... 108/62
4,095,533 A 6/1978 Leveille
4,958,577 A 9/1990 Demaio et al.
5,645,259 A * 7/1997 Chen ..... 248/188.6
5,884,566 A * 3/1999 Chen ..... 108/67
6,125,771 A * 10/2000 Platt et al. ..... 108/115

* cited by examiner

*Primary Examiner*—Jose V. Chen
(74) *Attorney, Agent, or Firm*—Richard C. Litman

(57) ABSTRACT

A portable collapsible table or tray having multiple wooden panels hinged to each other from underneath by a piece of fabric. The panels fold in a zigzag manner into a compact, folded form which is easily carried in a bag. The panels are secured to form a rigid table surface by inserting removable support rods laterally and crosswise through the wooden panels. The end panels each receive a locking rod at its respective outer side. Support panels having handle cutouts and legs are attached at each end of the table by hinges. These support panels have bores therethrough for inserting the support pins, and are thus locked in place, along with the wooden surface panels when the rods are inserted. The support panels fold with the surface panels when the support rods are removed forming a compact configuration. A game board version without support panels is provided.

9 Claims, 9 Drawing Sheets

PORTABLE COLLAPSIBLE TABLE AND GAME BOARD

BACKGROUND OF THE INVENTION

1. Field of the Invention

The present invention relates to tables, trays, and game boards. More particularly, the present invention relates to collapsible tables trays and game boards which may be carried in a convenient sized bag.

2. Description of the Related Art

Known collapsible tables are bulky and complicated, requiring a number of structural hinges to achieve a compact collapsed configuration. Known game boards are rigid or foldable. It would be desirable to provide a collapsible table of simple construction requiring a minimum of structural hinges, while having an attractive appearance and rigid table top for use. It would also be desirable to provide a game board which is rigid in use while being foldable for storage or transport.

U.S. Pat. No. 2,549,242, issued Apr. 17, 1951, to Ross, describes a collapsible combination screen and table having a series of panels that are hinged relative to one another and having legs that fold.

U.S. Pat. No. 2,693,258, issued Nov. 2, 1954, to Fleisch, describes a combination table and carrying case having two folding table surfaces and internally folding legs that double as handles.

U.S. Pat. No. 2,808,191, issued Oct. 1, 1957, to Cramer, describes a disposable lap tray of folded cardboard material or the like.

U.S. Pat. No. 3,884,159, issued May 30, 1975, to Faria, describes a folding table having a series of parallel slats and leg that collapse to a stacked arrangement and may be carried or stored in a carrying case.

U.S. Pat. No. 3,993,003, issued Nov. 23, 1976, to James, describes a collapsible stool having a series of slats connected in a side-by-side relationship by a series of flexible material hinges, the stool also including folding legs.

U.S. Pat. No. 4,095,533, issued Jun. 20, 1978, to Leveille, describes a tray having folding end panels serving as legs.

U.S. Pat. No. 4,958,577, issued Sep. 25, 1990, to Demaio et al., describes a roll-up lap tray having a large number of slats attached to fabric backing and made rigid by swivel member.

None of the above inventions and patents, taken either singly or in combination, is seen to describe the instant invention as claimed. Thus a portable collapsible table solving the aforementioned problems is desired.

SUMMARY OF THE INVENTION

The portable collapsible table of the present invention features multiple wooden panels or slats hinged to each other from underneath by a piece of fabric corresponding in size to the table or tray surface. The wooden panels fold in a zigzag manner into a compact, folded form which is easily carried in a bag. The wooden panels are secured to form a rigid table surface by inserting removable support rods laterally and crosswise through pin receivers in the wooden panels. The end panels each receive a locking rod at its respective outer side.

Support panels having handle cutouts and legs are attached at each outer side of the end panels by hinges so as to cover the sides of the end panels and form supports for the table. These support panels have bores therethrough for inserting the support pins, and are thus locked in place, along with the wooden surface panels when the rods are inserted. The support panels fold with the surface panels when the support rods are removed, thus forming a compact configuration for storage, along with the removed pins, in a bag.

An alternative structure for securing the panels into a rigid table surface includes slot pin locks located along the sides of the table surface located at the fabric hinges and fitting into opposed pin receiving and pin retraction slots in the adjacent panels. The slot pin locks can be withdrawn from the pin receiving slot of one panel and slid fully into the pin retraction slot of the adjacent panel, allowing the panels to fold on the fabric hinges. Other flexible web materials such as plastic sheet may be substituted for fabric.

A game board may be incorporated into the table surface as desired. In the case of a game board, the support panels may be omitted and the table surface used as a rigid game board. Embossed plastic sheet or printed paper bearing game board patterns such as a checker board may be substituted for fabric, the game board pattern material being placed on top of the surface and acting as hinges between inner and outer panels of a four panel board for folding purposes. In this case, the game board pattern material is split at the separation between inner panels and a sheet material, such as adhesive tape, placed on the underside of the board to act as a hinge between inner panels. The folded game board is compact and may be easily carried in a bag or the like, along with playing pieces.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a portable, collapsible table or tray having multiple wooden panels or slats hinged to each other from underneath by a piece of fabric corresponding in size to the table or tray surface. The wooden panels fold in a zigzag manner into a compact, folded form which is easily carried in a bag. The wooden panels are secured to form a rigid table surface by inserting removable support rods laterally and crosswise through rod receivers in the wooden panels. Support panels having handle cutouts and legs are attached at each outer side of the end panels by hinges so as to cover the sides of the end panels and form supports for the table.

An alternative structure for securing the panels into a rigid table surface includes slot pin locks located along the sides of the table surface located at the fabric hinges and fitting into opposed pin receiving and pin retraction slots in the adjacent panels. A rigid game board may also be constructed in a similar manner which is foldable for storage.

Figure 1:
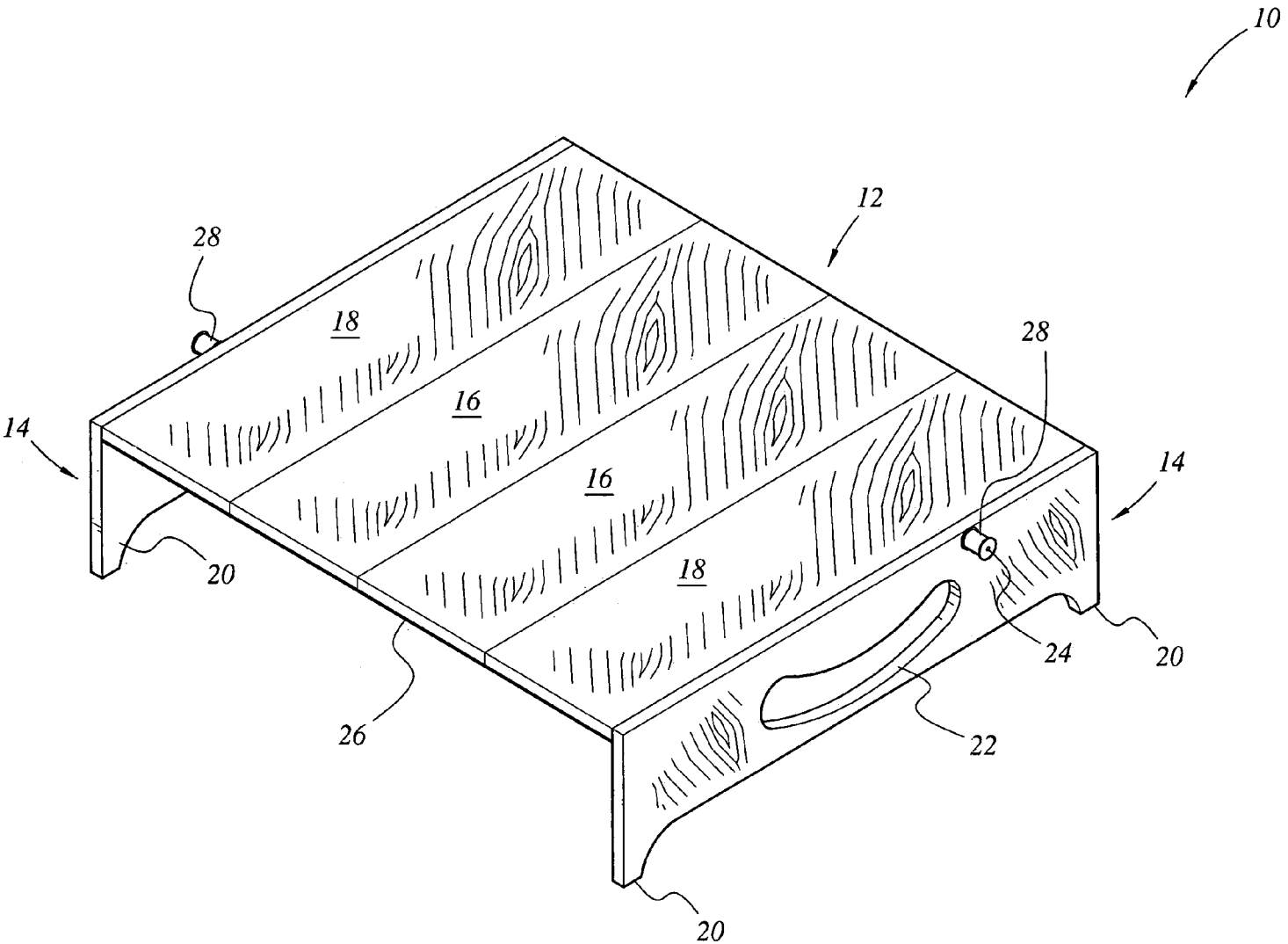
FIG. 1 is a perspective view of a portable, collapsible table or game board according to the present invention.
Figure 2:
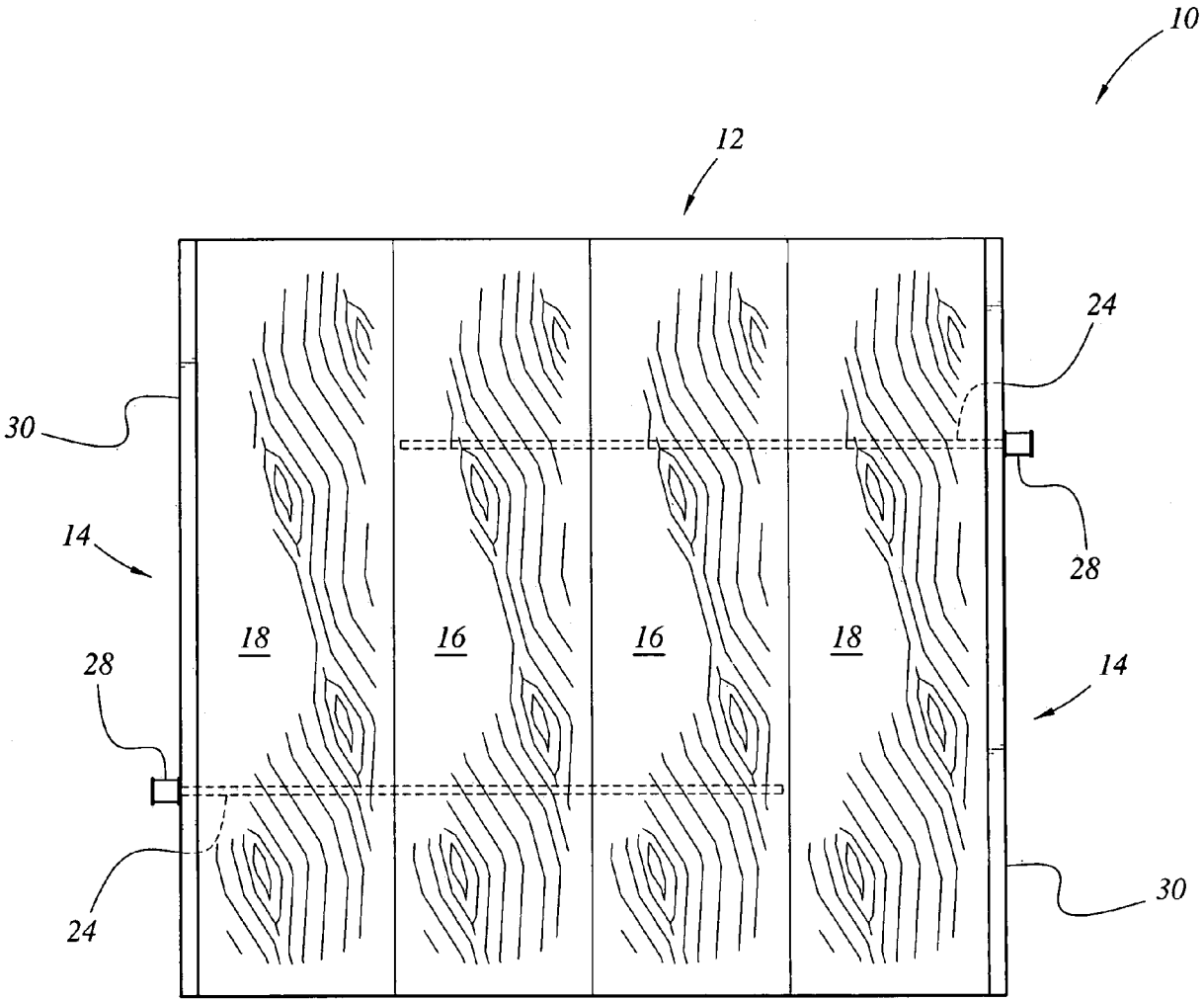
FIG. 2 is a plan view of the invention of FIG. 1.
Figure 3:
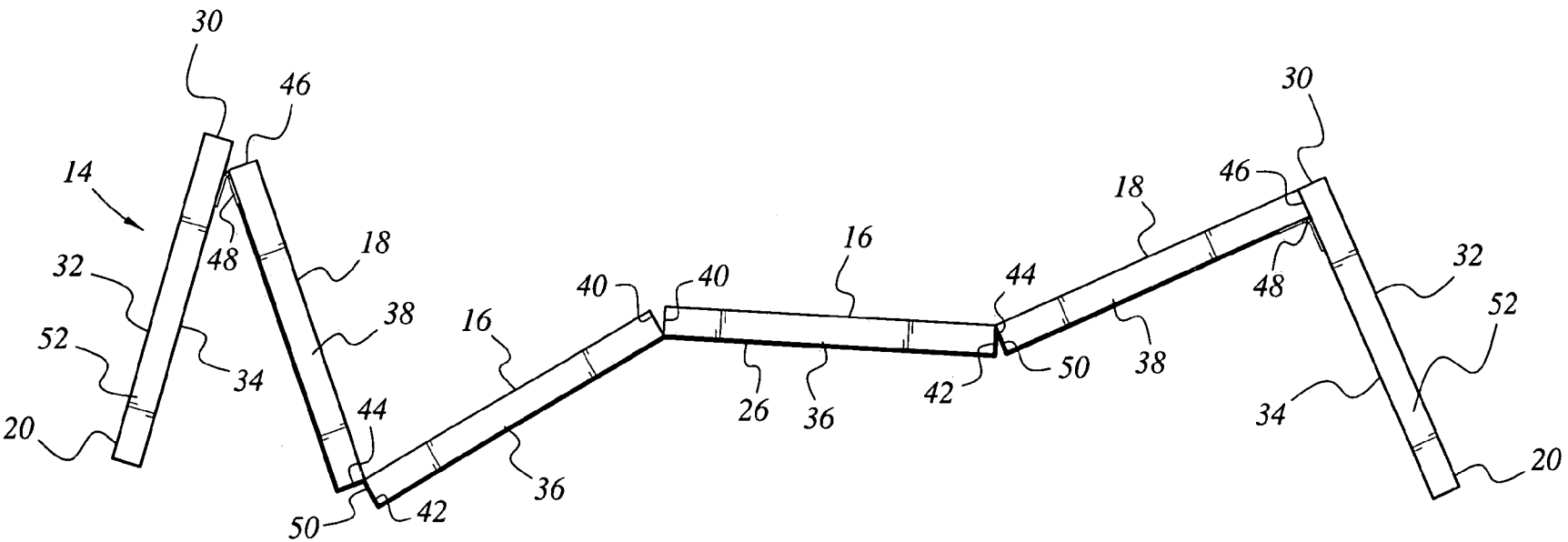
FIG. 3 is a side elevation view of the table or game board of FIG. 1 in a partially folded position.
Figure 4:
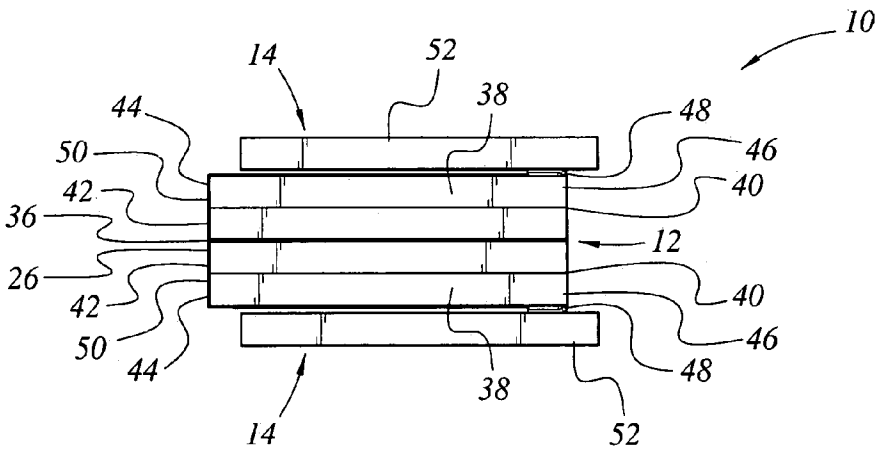
FIG. 4 is an end elevation view of the table or game board of FIG. 1 in its collapsed position.
Figure 5:
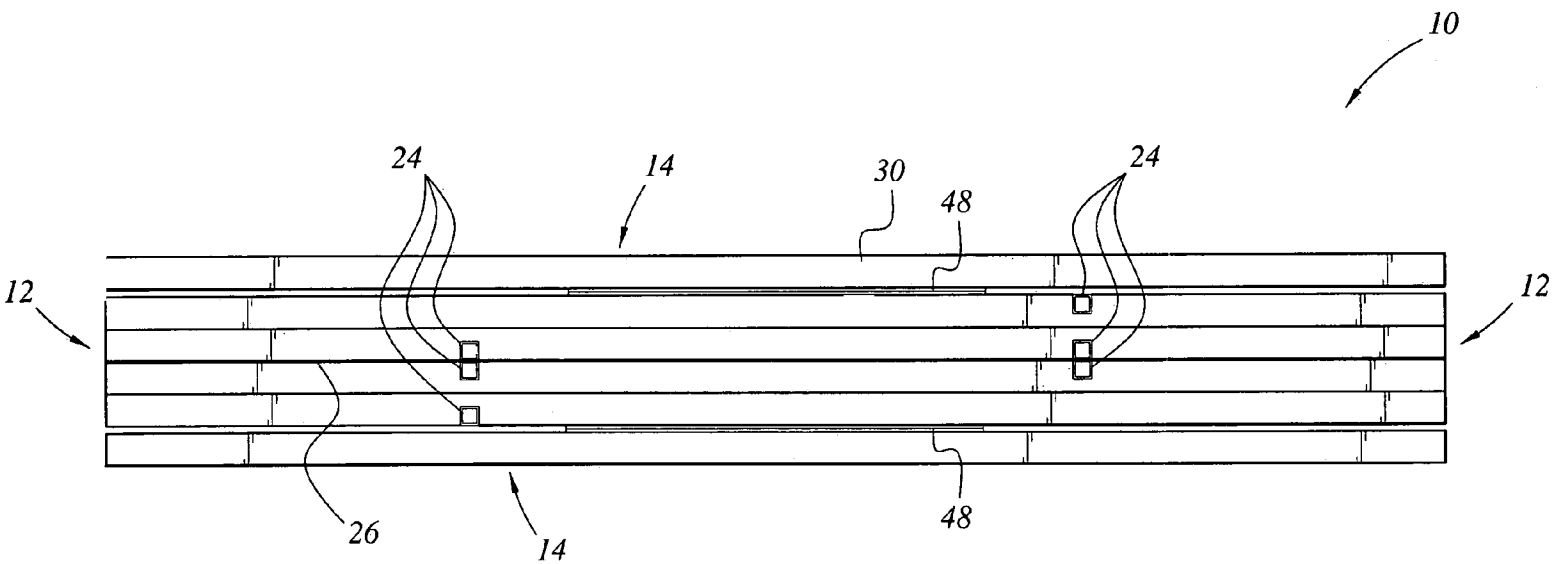
FIG. 5 is a plan view of the table or game board of FIG. 1 in its collapsed configuration.
Figure 6:
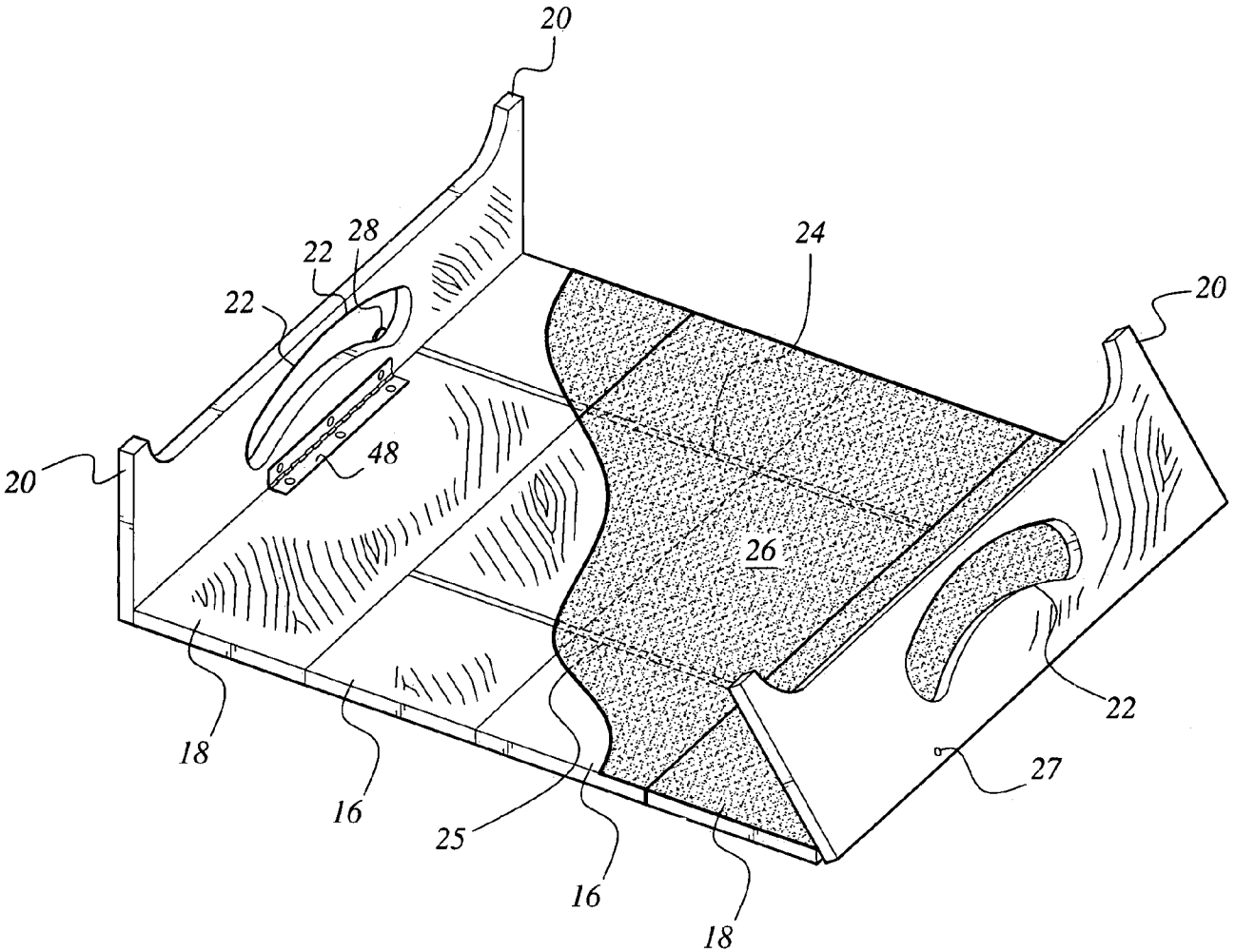
FIG. 6 is a bottom perspective view of the table or game board of FIG. 1.

Referring to FIGS. 1–7, there is shown a collapsible table system referred to by the reference number 10. Collapsible table system 10 includes a folding table top 12 having end supports 14 at each side thereof. As shown, table top 12 includes inner slats or panels 16 and outer slats or panels 18, the end supports 14 being attached to the outer sides of outer panels 18. End supports 14 have corner legs 20 and central handle cutouts 22. As illustrated in FIGS. 2 and 6, a pair of panel support rods 24 are inserted through support rod bores 27 extending through respective end supports 14, and then cross-wise and laterally into support rod receiver segments 25 of adjacent outer panels 18 and both inner panels 16. The support rod receiver segments 25 are bores formed by tubes of metal embedded in the underside of the panels as seen in FIGS. 5 and 6. The support rods 24 have handles 28 fastened at their outer ends for convenient grasping of the rods during insertion and removal.

Figure 7:
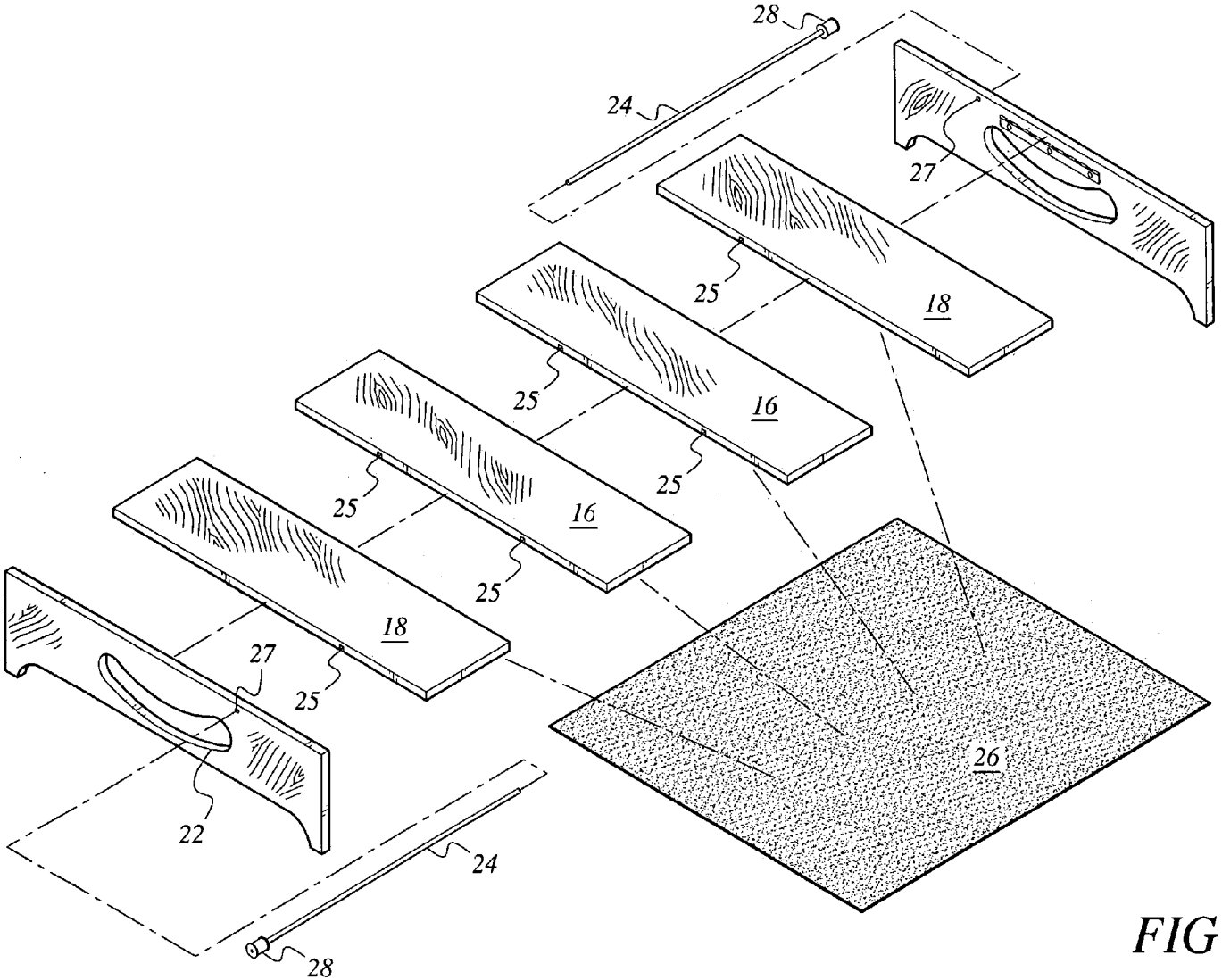
FIG. 7 is an exploded view of the table or game board of FIG. 1.

Support panels 14 have an exposed upper edge 30, an outer surface 32 and inner surface 34. Inner panels 16 have ends 36, inner sides 40 and outer sides 42. Outer panels 18 have ends 38 inner sides 44, and outer sides 46. As seen in FIGS. 6 and 7, support hinges 48 connect the outer sides of outer panels 18 with the inner surface of support panels 14 proximate their respective upper edges 30. As seen in FIGS. 3 and 4, support web folding hinges 50 are located between adjoining sides of inner panels 16 and outer panels 18. Support panel ends 52 are preferably even with inner panel ends 36 and outer panel, ends 38.

As seen in FIGS. 1, 3, and 6, the upper surfaces of panels 16 and 18 are exposed and may be finished or painted as desired. The lower surfaces of panels 16 and 18 are connected with folding support web 26. Folding support web 26 may be of cloth or other flexible material such as plastic sheet and it is preferably attached to panels 16 and 18 by glue or adhesive.

As shown in FIGS. 4, and 5, the collapsible table system 10 is folded in a compact configuration with all panels folded against adjacent panels. As seen in FIG. 3, the table system 10 as partially unfolded forms a zigzag shape with respective panel sides rotating toward each other around hinges 46, web supported hinges 50, and the hinge formed by web 26 at inner sides 40 of inner panels 16. The table system 10 may be easily set up for securing by inverting the table, placing the panels on a flat surface and rotating the support panels 22 upward. Support rods 24 may then be inserted into rod receiver segments 25, securing the table for use as shown in FIG. 1.

The table system 10 may be of any desired size, however, a relatively small table, the size of a coffee table or lap tray, is envisioned for convenient use. A table employing more than the four panels as shown may be constructed in a similar manner to that discussed above. Any appropriate wood having any desired finish thereon may be employed in the present invention. Other suitable materials may be used in place of wood, such as plastic. Decorations or game board figures may be placed on the upper surfaces of the panels as desired.

Figure 8:
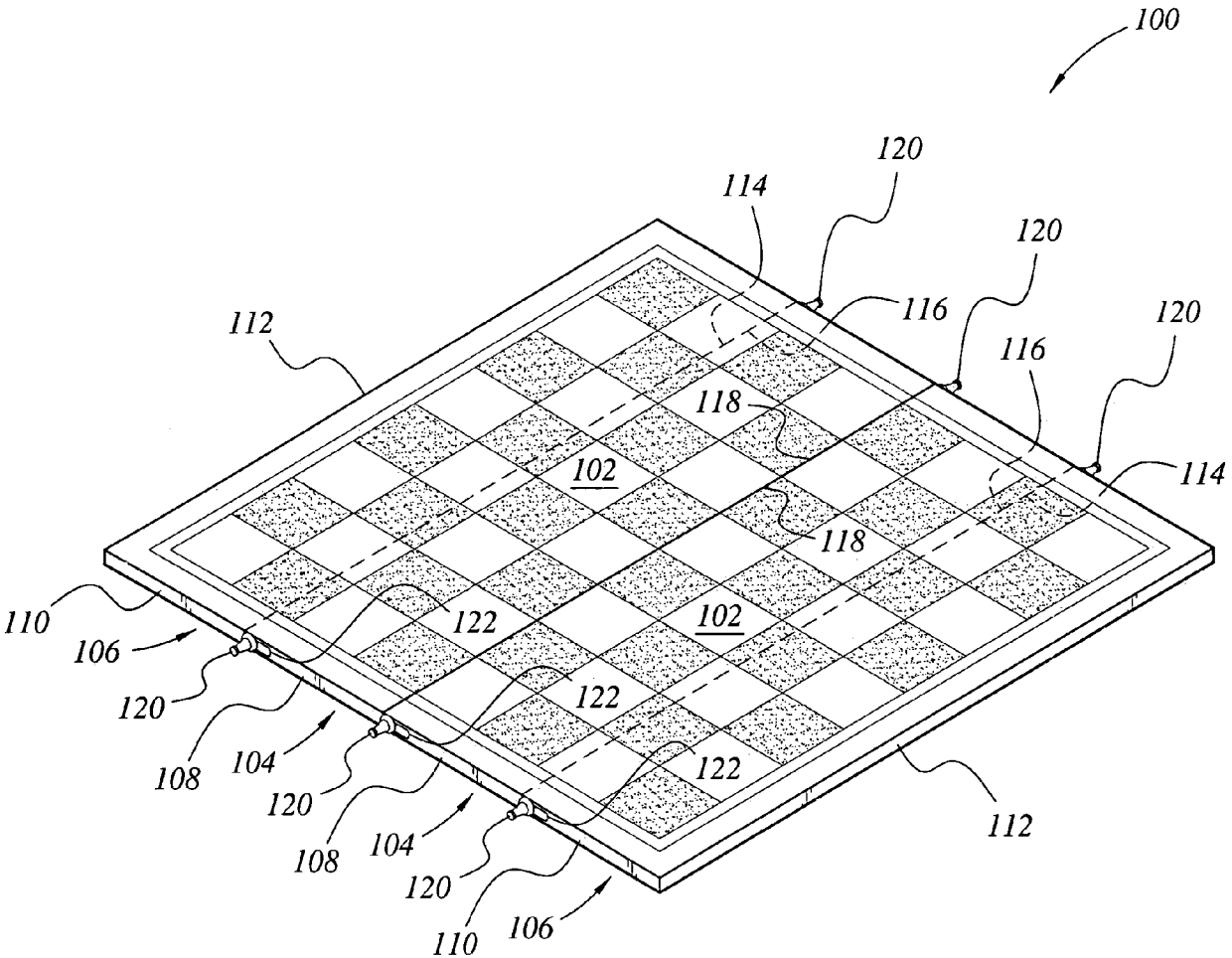
FIG. 8 is a perspective view of another embodiment of the collapsible table or game board according to the present invention.
Figure 9A:
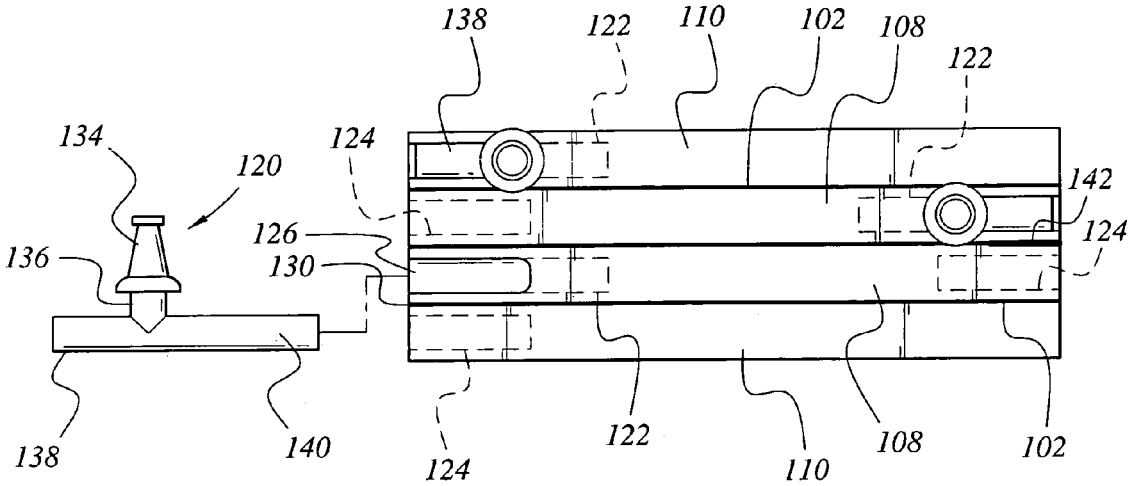
FIG. 9A is a partially broken away side elevation view of the embodiment of FIG. 8 in a collapsed configuration.
Figure 9B:
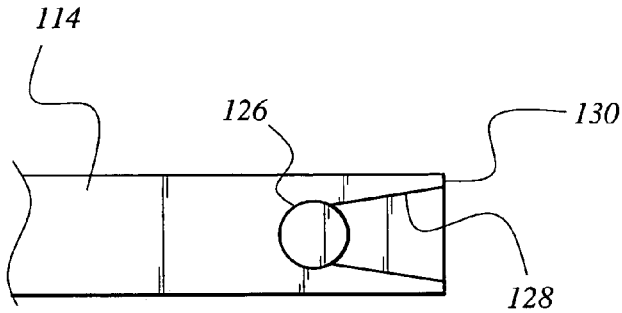
FIG. 9B is a detail view of a side of a panel of the embodiment of FIG. 8 showing the lock pin retraction slot.
Figure 10:
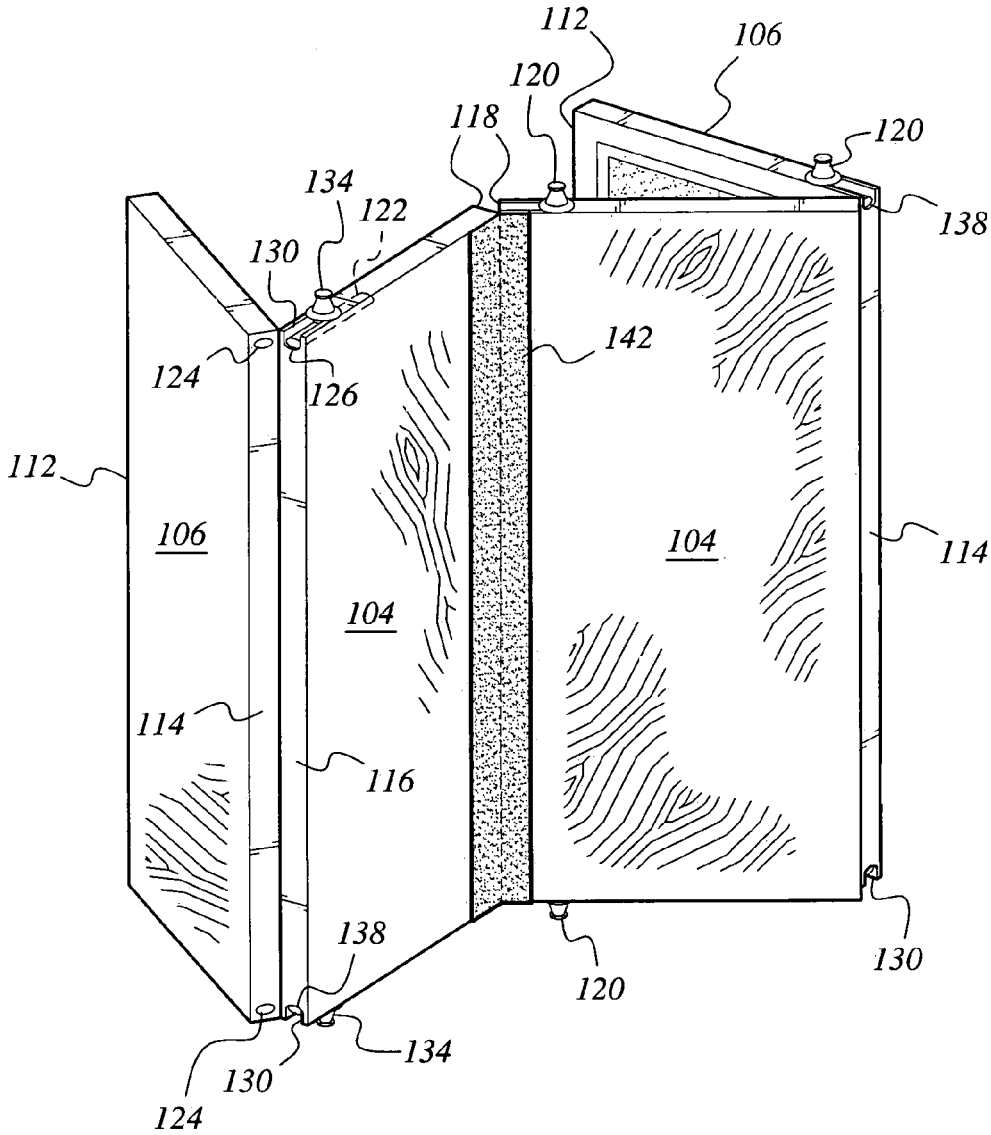
FIG. 10 is a bottom perspective view of the embodiment of FIG. 8 in a partially folded configuration.

Referring to FIG. 8–10 there is shown another embodiment of the invention wherein a foldable table top or game board 100 is shown. The game board may be made into a rigid configuration by employing support rods and rod receivers similar to those of the collapsible table embodiment described above. An alternative system for converting the game board, 100 between a folded configuration and a rigid configuration is shown in FIG. 8.

Folding or collapsible game board 100 has a game board image-bearing web 102 of plastic, cloth, or paper attached to the upper surfaces of inner panels 104 and outer panels 106. Inner panels 104 have ends 108 and outer panels 106 have ends 110, forming the sides of the game board 100. Outer panel outer sides 112 form the ends of the game board facing the players. Outer panel inner sides 114 are adjacent to inner panel outer sides 116 and are connected by game board web 102 which acts as a folding hinge therebetween. Inner panel inner sides 118 are held adjacent for folding by a web hinge on the underside as seen in FIG. 10. Game board image bearing web 102 is split at the intersection of inner panel inner sides 118.

Panels 116 and 118 are shown connected in a rigid position by slot pin locks 120 located at each hinge at each side of the game board 100. Slot pin locks 120 are movable between a locked position (see FIG. 8) and an unlocked position (see FIGS. 9–10). Referring to FIGS. 9A, 9B, and 10, opposed lock pin retraction slots 122 and lock pin receiving slots 124 form a continuous slot for slot pin locks 120 in corresponding adjacent panel end portions in the closed position. Lock pin retraction slots 122 have an inner lock pin slot 126 and an open stem groove 130 formed by groove walls 128.

Slot pin locks 120 include lock handle 134, having stem 136 connected perpendicularly to a sliding pin 140 at the intersection of insertion pin portion 138. In the locked position as in FIG. 8, lock handle 134 and stem 136 are located at the side of the panel having retraction slot 122, inner lock pin slot 126 and open stem groove 130 with the insertion pin portion 138 inserted into lock pin receiving slot 126 of the adjacent panel. To open the slot pin locks for folding the game board 100, slot lock handle 134 is grasped and sliding pin 140 is moved within lock pin retraction slot 122 until the insertion pin portion 138 of sliding pin 140 is clear of lock pin receiving slot 124. The slot lock handle 134 and slot lock stem 136 are moved in open stem groove 130 to the unlocked position away from the panel side. The adjacent panel is then free to be folded away for storage. The panels may be locked together to form a rigid game board by reversing the steps above.

It is to be understood that the present invention is not limited to the embodiments described above, but encompasses any and all embodiments within the scope of the following claims.

We claim:

1. A portable collapsible table or game board, comprising:

a plurality of slat-like panels, each panel having an upper surface and a lower surface defining a thickness, opposed inner and outer sides, and opposed ends;

a flexible web;

said plurality of slat-like panels being attached to said web along one of said upper surface and said lower surface and located mutually adjacent;

said panels being connected to said web at their respective upper surfaces, wherein said panels include two adjacent inner panels and two outer panels, the inner sides of which are adjacent respective outer sides of said inner panels;

said flexible web forming hinges for allowing the folding of said adjacent panels into a collapsed configuration and the unfolding of said adjacent panels into a set-up configuration;

a hinge web fastened to said inner panel lower surfaces forming a hinge for allowing the folding of said inner panels into said collapsed configuration and the unfolding thereof into said set-up configuration; and means for engaging adjacent panels to form a rigid table or game board having an upper surface in the set-up configuration and for disengaging said adjacent panels to form the collapsed configuration;

said means for engaging and disengaging adjacent panels comprising slot pin locks located proximate the ends of said adjacent panels, said slot pin locks having a lock handle, a sliding pin, a stem connecting said lock handle and said sliding pin, said stem being perpendicular to said sliding pin, said sliding pin having an insertion portion, one of said adjacent panels having a lock pin receiving slot extending inward from its respective adjacent side, proximate and spaced from its said end, the other of said adjacent panels having a lock pin retraction slot extending inward from its adjacent respective side and aligned with said lock pin receiving slot when in the open position, said retraction slot including an inner lock pin slot and an open stem groove for receiving said slot pin lock stem, said groove being formed by opposed open groove walls.

2. The collapsible table or game board of claim 1, said table or game board having one of said slot pin locks for reversibly joining each adjacent panel on each side of said table or game board.

3. A portable collapsible table or game board, comprising:

a plurality of slat-like panels, each panel having an upper surface and a lower surface defining a thickness, opposed inner and outer sides, and opposed ends;

a flexible web;

said plurality of slat-like panels being attached to said web along one of said upper surface and said lower surface and located mutually adjacent;

said panels being connected to said web at their respective lower surfaces;

said panels including two adjacent inner panels and two outer panels, the inner sides of which are adjacent respective outer sides of said inner panels;

said flexible web forming hinges for allowing the folding of said adjacent panels into a collapsed configuration and the unfolding of said adjacent panels into a set-up configuration;

said flexible web forms hinges between said respective inner panels and said outer panels by extending upward and then downward between and are connected to the respective outer sides of said inner panels and the inner sides of said outer panels, so as to form hinges at said upper surface of said rigid table or game board;

said outer sides of said outer panels forming opposed ends of said table or game board when in said rigid configuration and the collective said ends of said inner and said outer panels forming opposed sides of said table or game board;

at least one support rod receiver defined by said panels and extending through an end of said table or game board formed by one of said outer sides of said outer panels and extending laterally and crosswise through at least said outer panel and both said inner panels;

an insertable and removable support rod corresponding to each said support rod receiver for extending through said support rod receiver;

whereby, upon insertion of said support rod into its corresponding support rod receiver, a rigid table or game board is formed having an upper surface and a lower surface when in the set-up configuration for use; and whereby, upon removal of said support rods, the collapsed configuration is formed when folded for storage.

4. The collapsible table or game board of claim 3, wherein said at least one support rod receiver include two support rod receivers extending from opposed ends of said table or game board, wherein said support rod receivers are aligned bores defined by said panels.

5. The collapsible table or game board of claim 4, wherein said support rod receivers are aligned metal tube segments imbedded in said panels at their respective undersides.

6. The collapsible table or game board of claim 5, further comprising support panels hingedly attached to respective said opposed ends of said table or game board so as to rotate between a vertical support position and a folded position against said lower surfaces of said respective outer panels, said support panels having respective upper edges and panel ends.

7. The collapsible table or game board of claim 6, said support panels having centrally disposed handle cutouts.

8. The collapsible table or game board of claim 7, said support panels forming legs at their respective ends.

9. The collapsible table or game board of claim 6, said support panels defining bores therethrough aligned with respective said support rod receivers when said support panels are in the vertical position for receiving said support rods, said support panels being locked in the upright position when said support rods are inserted through said support panel bores and into said support rod receivers.

* * * * *